US010537898B1

(12) United States Patent
Davis

(10) Patent No.: US 10,537,898 B1
(45) Date of Patent: Jan. 21, 2020

(54) DEVICE AND METHOD FOR PROCESSING SOLID WASTE MATERIAL

(71) Applicants: Safe Medical Technology, Inc., Mansfield, OH (US); SMT Medical Technologies, LLC, Hartland, WI (US)

(72) Inventor: Mark Davis, Mansfield, OH (US)

(73) Assignees: SMT MEDICAL TECHNOLOGIES, LLC, Hartland, WI (US); SAFE MEDICAL TECHNOLOGIES, INC., Mandfield, OH (US)

( * ) Notice: Subject to any disclaimer, the term of this patent is extended or adjusted under 35 U.S.C. 154(b) by 724 days.

(21) Appl. No.: 15/134,121

(22) Filed: Apr. 20, 2016

Related U.S. Application Data

(60) Provisional application No. 62/150,121, filed on Apr. 20, 2015.

(51) Int. Cl.
*B02C 19/00* (2006.01)
*B02C 18/14* (2006.01)
*B02C 18/16* (2006.01)

(52) U.S. Cl.
CPC ..... *B02C 19/0075* (2013.01); *B02C 18/142* (2013.01); *B02C 18/145* (2013.01); *B02C 18/16* (2013.01)

(58) Field of Classification Search
CPC ..... B02C 19/0075; B02C 18/00; B02C 18/02; B02C 18/04; B02C 18/06; B02C 18/086; B02C 18/14; B02C 18/141; B02C 18/142; B02C 18/143; B02C 18/144; B02C 18/145; B02C 18/146; B02C 18/148; B02C 18/16; B02C 18/162; B02C 18/18; B02C 18/22; B02C 18/2225; B02C 18/2291
See application file for complete search history.

(56) References Cited

U.S. PATENT DOCUMENTS 2,008,049 A 7/1935 Staude
3,750,966 A * 8/1973 Anderson ..... A61M 5/3278 241/100
4,809,915 A 3/1989 Koffsky et al.
4,971,261 A 11/1990 Solomons
5,046,669 A * 9/1991 Wallace ..... A61M 5/3278 241/23
5,340,003 A 8/1994 Wilson
5,340,039 A 8/1994 Lefevre
5,354,000 A * 10/1994 Wright ..... A61L 11/00 241/100
5,683,044 A 11/1997 Gueldenpfennig et al.
6,186,428 B1 2/2001 Robinson et al.
6,641,006 B2 11/2003 Kamiya
7,156,329 B2 1/2007 Hay et al.
7,198,213 B2 4/2007 Kolbet et al.
(Continued)

*Primary Examiner* — Matthew Katcoff
(74) *Attorney, Agent, or Firm* — Donald J. Ersler

(57) ABSTRACT

A medical waste processing device includes an outer housing, material intake chamber having a passageway through which material passes, and cutting members contained within the housing that cuts and shreds the waste material before entering a waste receptacle that is located in the lower portion of the housing. A vacuum filter system is further provided to capture and filter potentially harmful aerosols that may be emitted during operation of the device. A method is also provided for reducing the volume of waste material through operation of the electrical shredding device.

27 Claims, 3 Drawing Sheets

(56) References Cited

U.S. PATENT DOCUMENTS

| | | | | |
|---|---|---|---|---|
| 7,284,715 | B2 * | 10/2007 | Dziesinski | B02C 18/0007 241/100 |
| 7,578,460 | B2 * | 8/2009 | Berger | E03C 1/2665 241/46.014 |
| 8,091,401 | B2 * | 1/2012 | Chen | B21D 37/205 241/297 |
| 2007/0246582 | A1 | 10/2007 | Aries et al. | |
| 2008/0011888 | A1 | 1/2008 | Dziesinski et al. | |
| 2008/0149224 | A1 | 6/2008 | Kappel et al. | |
| 2012/0001003 | A1 | 1/2012 | Davis | |
| 2016/0318033 | A1 * | 11/2016 | Hengl | B02C 18/2233 |

* cited by examiner

DEVICE AND METHOD FOR PROCESSING SOLID WASTE MATERIAL

CROSS REFERENCE TO RELATED APPLICATIONS

This application claims the benefit of the filing date under 35 U.S.C. § 119(e) of Provisional Application For Patent Ser. No. 62/150,121 filed Apr. 20, 2015, which is hereby incorporated by reference in its entirety.

TECHNICAL FIELD

The disclosure relates to a device and method for processing medical waste. More particularly, this disclosure relates to a device and method for shredding medical needles and syringes.

BACKGROUND

The problems associated with the destruction and decontamination of medical waste are well-known. Syringes, plastic blood bags, metal clips, hoses, etc. present formidable problems for disposal. Not only are they difficult to deal with due to safety risks to handlers and health compliance regulations, but also they are contaminated with viral and bacterial pathogens which make their handling hazardous. These items must be decontaminated, rendered harmless and disposed of to prevent the transmission of disease, and to avoid accessibility of used needles and syringes and for purposes of general sanitation.

Devices adapted for the disposal of hospital waste are known. However, they suffer from a number of limitations, such as safety problems, including leaks and other shortcomings which make them not particularly suitable to institutional applications where relatively unskilled workers are employed as operators. Moreover, since these devices are employed for the disposal of glass, plastic and other implements, the wear and tear on the devices is considerable. The users are generally incapable of keeping the devices in proper adjustment to avoid damage. They thus require either the presence of a skilled mechanic on staff or frequent calls by the manufacturer's skilled service mechanic.

Since the advent of the disposal syringe and other disposable medical articles, there has also arisen a need for a method to prevent their misuse and theft. In hospitals today there is a tremendous volume of these articles, which after being used, must be accounted for by some method or another, all of which takes precious time. There is an ever-growing problem with theft of used syringes for illegal intra-venous drug use and/or for drug diversion.

Typically, syringes and needles are simply thrown into sharps containers and stored until the containers are collected by waste processing and disposal personnel of a facility. Storage of whole syringes and needles also pose safety risks for waste disposal collection personnel. There exists the possibility of containers breaking and collection personnel accidentally getting stuck with contaminated needles. Accordingly, it is desirable to provide a device and method for disposing and reducing the volume of waste material. Therefore, there remains a need for a shredding and disposing device which is sanitary, safe to use, and can process large volumes of needles and syringes, particularly, but without limitation, on the same site as they are generated.

SUMMARY

Figure 1:
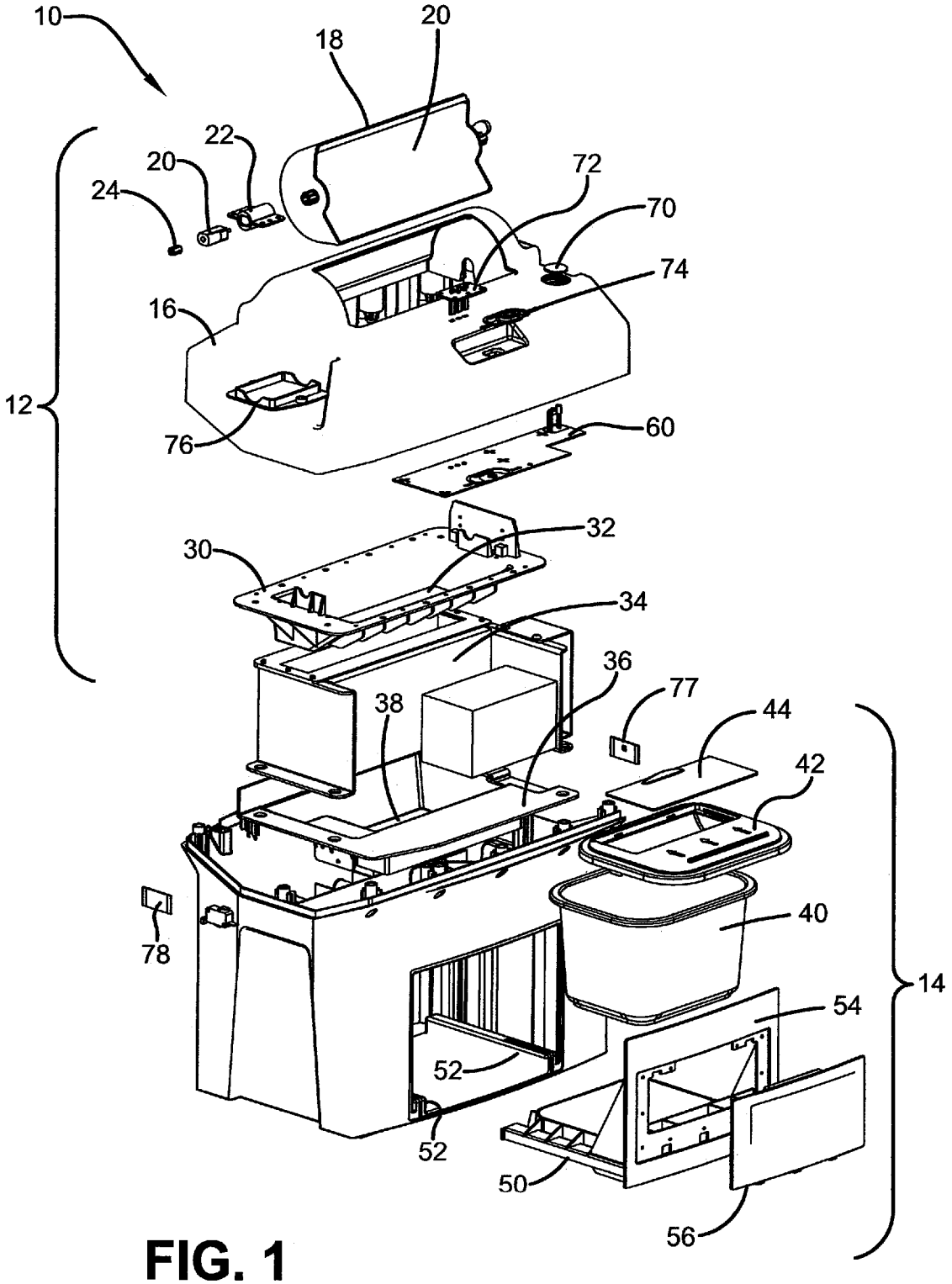
FIG. 1 is an exploded perspective view of an illustrative embodiment of the waste processing device.

Provided is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members.

According to certain embodiments, disclosed is a waste processing device comprising a housing having an upper region and a lower region and including an anti-microbial additive, a material intake member and cutting region located in the upper region, a pair of elongate counter-rotational cutting members located within the cutting region carrying a plurality of cutters having cutting teeth mounted at different angular positions relative to adjacent cutters, and means to drive the pair of elongate cutting members.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, and a vacuum for extracting material generated during operation of said device.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, and a filter for filtering the internal atmosphere of said device.

According to certain embodiments, disclosed is a waste processing device comprising a housing having an upper region and a lower region, a material intake member and cutting region located in the upper region, a pair of elongate counter-rotational cutting members located within the cutting region carrying a plurality of cutters having cutting teeth mounted at different angular positions relative to adjacent cutters, means to drive the pair of elongate cutting members, a vacuum for extracting material generated during operation of said device; and a filter for filtering the internal atmosphere of said device.

DETAILED DESCRIPTION

The disclosure relates to a device for shredding waste and method for reducing the volume of waste material. Provided is a device for processing waste, such as medical and hospital waste. The device comprises an outer housing, a material intake chamber defining a passageway and having an opening that communicates with the atmosphere and with the interior of the housing. A cutting member is contained within the housing for cutting and shredding waste that has been inserted into the material intake chamber of the device. The device includes a motor to drive the cutting members.

The housing of the device includes an upper region and a lower region that is located below the upper region. The upper region of the device includes a top wall. The material intake member is located in the top wall of the housing. The material intake member comprises an elongate member that extends horizontally along the top wall of the housing. The material intake member comprises a cavity for accepting medical waste to be processed. According to certain illustrative embodiments, the material intake member comprises a horizontal tray-like member that has a suitable cavity for accepting one or more medical syringes that are placed into the tray in a substantially horizontal position for processing. According to one embodiment, the material intake member is driven by an electric motor and is capable of opening and closing to accept waste material to be processed. According to other embodiments, the material intake member is operated by an uninterrupted power supply (UPS). Without limitation, and only by way of example, the battery of the UPS may be trickled charged by solar energy or charged by AC power.

The cutting region of the device is located in the upper region of the housing. The cutting members of the device are located within the cutting region for shredding waste that has entered the housing from the material intake tray. Positioned between the lower portion of the material intake tray and the cutting members is an upper horizontal wall that separates the material intake tray from the cutting members. The upper horizontal wall includes an opening or chute for transferring waste to be processed from the material intake tray to the cutting members located in the cutting region.

The device includes a pair of elongate rotatable cutting members that are located in the cutting region of the housing. The cutting members are located substantially in the same horizontal plane and are arranged for counter-rotation relative to one another. Each of the elongate cutting members comprise a plurality of spaced-apart cutters that are mounted on rotatable shafts. Each of the cutters are substantially circular in shape and have a plurality of cutting teeth extending radially from the outer circumference of the cutter. The cutters on each of the rotating shafts are axially separated from adjacent axial cutters along the longitudinal axis of the cutting members. The cutters of the cutting members are offset along the longitudinal axis of the cutting members from the cutters of the other cutting member. As the pair of rotatable cutting members counter-rotate relative to one another during the waste shredding process, the cutters on one of the cutting members may pass through the axial separation of the adjacent cutters carried on the other of the cutting member of the pair of rotatable cutting members. Each of the cutters of the cutting members are mounted on the rotatable shaft so that immediately adjacent cutters do not have cutting teeth in the same angular position. The mounting of the cutters on the rotatable shafts in this manner forms a helical pattern of cutting teeth along the longitudinal length of each of the cutting members.

According to certain illustrative embodiments, each of the rotatable cutting members includes at least one row of cutting teeth extending in a substantially helical pattern along at least a portion of the longitudinal axis of the rotatable cutting member. According to other illustrative embodiments, each of the rotatable cutting members includes at least one row of cutting teeth extending in a substantially helical pattern along substantially the entire length of the longitudinal axis of the rotatable cutting member. According to other illustrative embodiments, each of the rotatable cutting members includes at least one row of cutting extending in a substantially helical pattern along the entire length of the longitudinal axis of the rotatable cutting member.

According to certain illustrative embodiments, each of the rotatable cutting members includes a plurality of rows of cutting teeth extending in a substantially helical pattern along at least a portion of the longitudinal axis of the rotatable cutting member. According to other illustrative embodiments, each of the rotatable cutting members includes a plurality of rows of cutting teeth extending in a substantially helical pattern along substantially the entire length of the longitudinal axis of the rotatable cutting member. According to other illustrative embodiments, each of the rotatable cutting members includes a plurality of rows of cutting teeth extending in a substantially helical pattern along the entire length of the longitudinal axis of the rotatable cutting member.

The cutting members extend between spaced-apart mounting brackets, are carried by a shaft, and are driven by an electric motor. The cutters are also specially designed with specific angular adjustments to adapt to small and large objects through adjustment with an adjustment pin. The cutters may also be self-sharpening and self-lubricating.

Each of the cutting members include a specific angular design. Each cutting tooth of the cutters has a first surface that extends outwardly from the outer circumference of the cutter at a 90° angle from the point on the surface from which it emanates and a second surface that extends outwardly from the outer circumference of the cutter at a 70° angle from the point on the surface from which it emanates until it meets the end of the first surface. The angular design of the teeth of the cutters have an auger effect on the syringes, thereby pulling the syringe into the cutting members substantially horizontally as opposed to vertically.

According to certain embodiments, the device may include an electric motor to rotate cutting members. The electric motor may be powered by batteries or any other source of suitable electric current. The motor may rotate the cutting member(s) about their respective rotary axes at variable rotational speeds. The device may also include a timed stopping mechanism to shut off the motor after a pre-determined period of time. According to further embodiments, the means to drive the cutting members may be powered by any international power source.

A lower horizontal wall divides the upper and lower portions of the housing of the device. The lower horizontal wall includes an opening or chute to permit shredded medical waste to move from the cutting region into the collection member located in the lower region of the housing. Positioned below the cutting region is the lower collection region where the processed medical waste material is collected. The lower collection region of the housing includes a retractable tray for carrying a collection member, such as a bio-hazard sharps container. The retractable tray is engaged with spaced-apart mounting rails that permit the tray to be retracted and re-inserted into the lower region of the housing. The front wall of the housing includes a handle for retracting and inserting the tray into the housing. The sharps collection container contained in the lower region of the waste processing device may be locked with a suitable locking mechanism for security and safety purposes.

According to illustrative embodiments, the device further comprises a fan and air filter system. A filter member may be utilized in fluid connection with the fan to remove contaminants from the medical waste being processed in the inside environment of the housing. Without limitation, and by way of illustration, the device may utilize chemical, deep pleated, electronic, fiberglass or polyester, HEPA, ordinary flat or pleated, permanently charged electrostatic and washable/reusable filters. According to other illustrative embodiments, the filter comprises a HEPA filter. The filter and fan may be positioned on the rear wall of the system with the fan being positioned exteriorly from the filter frame to draw air from the interior of the housing through the filter member. The filtering system the filtering member consumes potentially contaminated air during every waste shredding sequence carried out of the device. The vacuum filtering system ensures that no potentially hazardous airborne aerosols generated during the shredding process are emitted to the environment outside of the housing of the device. According to alternative embodiments, a vacuum pump may be utilized to move air in or out of the device for the purpose of extracting gas or vapor that may be emitted from the waste material. Without limitation, and by way of illustration, the device may be comprised of vacuum pumps, such as positive displacement pumps, momentum transfer pumps, molecular pumps and entrapment pumps.

The walls of the housing may include an anti-microbial additive to minimize or eliminate microbes that may be present in the medical waste being shredded by the device. For example, and without limitation, the anti-microbial additive may be provided in the form of surface coating that is applied to the inner wall surfaces of the material intake chamber. Alternatively, the anti-microbial additive may be an incorporated into the walls of the material intake chamber itself. For example, the walls of the material intake chamber may be comprised of a plastic material with the antimicrobial additive incorporated therein. Without limitation, the anti-microbial agent may be a silver-containing compound or composition.

Provided is a method for processing waste with the waste processing device. The device includes a hands-free activation of the material intake member that utilizes a sensor comprising a light emitting diode that emits infrared radiation, ie, infrared LED or IR-LED. In the event that the hands-free activation of the material intake member fails, the device includes a redundant activation back up comprising a push button activation.

Once the syringe(s) to be processed have been placed into the material intake member, the material intake tray is activated and rotates along its longitudinal axis to drop the syringes to be processed in a horizontal fashion through the chute in the upper into the cutting region. In the cutting region of the housing, then syringes are shredded by the two elongate cutting members and the shredded material exits the cutting region through the lower horizontal wall and drops into the collection unit positioned in the lower portion of the housing.

According to certain illustrative embodiments, the position of the elongated rotatable cutting members relative to one another may be adjusted to accept small, large, or even extra-large waste objects to be shredded. According to these embodiments, one of the opposed rotatable cutting members of the pair of elongated rotatable cutting members is spring-loaded. The other opposed rotatable cutting member of the pair of elongated cutting members is not spring-loaded, but remains rotatable in its fixed longitudinal axis. The elongated spring-loaded cutting member is engaged on both opposite longitudinal ends with a bolt, spring and tensioner. The spring-loaded cutting member permits the space or width between the cutting teeth carried by the two opposed cutting members to be adjusted. The tension on the spring may be adjusted by the operator to permit a desired forward and backward movement of the spring-loaded cutting member, thereby adjusting the width between the cutting teeth of the spring-loaded cutting member and the non-spring loaded cutting member to accommodate larger objects. The spring-loaded cutting member also permits the angles of the cutting teeth carried by the cutting members of be rotated in multiple degrees, relative to one another, to accommodate larger materials.

The waste processing device further includes a sensor to indicate to the user when the waste collection container located in the lower region of the housing of the device is full and cannot accept additional shredded materials. The device includes a audibly and/or visually perceptible signal to alert or otherwise indicate to the operator that the collection container is full. When the collection container is full, the device will shut down until the container is removed and replaced by an empty collection container. The device will then be able to resume shredding additional waste material for another fill cycle.

The micro-processor of the waste processing device includes different default programs that may be utilized in the operation of the device. For example, and only by way of illustration, a certain default setting determines how long the waste processing device will run during an individual shredding sequence. To accommodate a situation in which a waste material becomes jammed in the cutting members, the micro-processor may also be programmed to permit the shredding sequence to stop, run in reverse for a period of time (for example, about 3 second), and then commence rotating in forward direction again. The waste processing device may include a counter to determine how many items of waste material were shredded during the fill cycle of the sharps collection container.

The shredding process results in consolidation of sharps for safe, easy and cost-effective disposal. Following the shredding process, the same volume of non-shredded syringes that would typically fill 2 one gallon sharps disposal containers may be disposed of in one 2.7 quart sharps disposal container. Thus, the shredding process using the device of the present disclosure results in about a 5:1 space savings. The device eliminates handling risks and reduces the volume of the discarded syringes and needles. Reducing the volume of discarded syringes and needles also increases the amount of syringes and needles that can be stored in a waste receptacle or sharps containers, thereby translating into substantial savings in handling fees, less land fill debris, less likelihood of handlers being pricked with needles, and prevents thieves from stealing the syringes and needles.

The certain illustrative embodiments of the device will be described in further detail with respect to the Figures. It should be noted that the device should not be limited to the illustrative embodiments depicted by the Figures.

FIG. 1 is an exploded perspective view of the device 10. The device 10 includes an upper region 12 and a lower region 14 that is located below the upper region. The upper region 12 of the device 10 includes a top wall 16. The material intake member 18 is movably engaged with the top wall 16 of the housing. The material intake member 18 comprises an elongate member that extends horizontally along the top wall 16. The material intake member 18 comprises a cavity 20 for accepting medical waste to be processed. The material intake member 18 is opened and closed by an electric motor 20 housed in a motor housing 22 and affixed to the top 16 with a connecter 24.

Positioned between the lower portion of the material intake member 18 and the cutting members is an upper horizontal wall 30 that separates the material intake member 18 from the cutting members. The upper internal horizontal wall 30 includes an opening or chute 32 for transferring waste to be processed from the material intake member 18 to the cutting members located in the cutting region 34.

A lower horizontal internal wall 36 divides the upper 12 and lower regions 14 of the housing of the device 10. The lower horizontal wall 36 includes an opening or chute 38 to permit shredded medical waste to move from the cutting region 34 into the collection member 40 located in the lower region 14 of the housing. The lower collection region 14 of the housing includes a retractable tray 50 for carrying a collection member 40, such as a bio-hazard sharps container having a top 42 and lid 44. The retractable tray is engaged with spaced-apart mounting rails 52 that permit the tray to slide into and out of the lower region 14 of the housing. The front wall 54 of the housing includes a handle 56 for retracting (pulling) and inserting (pushing) the tray 50 into the housing. The device 10 also includes a computer processor 60 which can set multiple defaults and additional features such as running time, troubleshooting error codes, if something were placed into the chamber that is not a needle and syringe, such as a solid steel screwdriver, the machine would attempt to start the shredding process but will detect a foreign object and cutting members would automatically shift into reverse then stop, the lid will open and the error code will direct the user to remove the foreign object. The IR light emitting diode 70, LED lens 72, redundant push button 74 and power adapter 76 are positioned in the top wall 16 of the device 10. The IR transmitter 77 is mounted on the side wall of the lower housing cover 15 of the device 10. The IR receiver 78 is mounted on the side wall of the lower housing cover 15 of the device 10 opposite the side of the IR transmitter 77.

Figure 2:
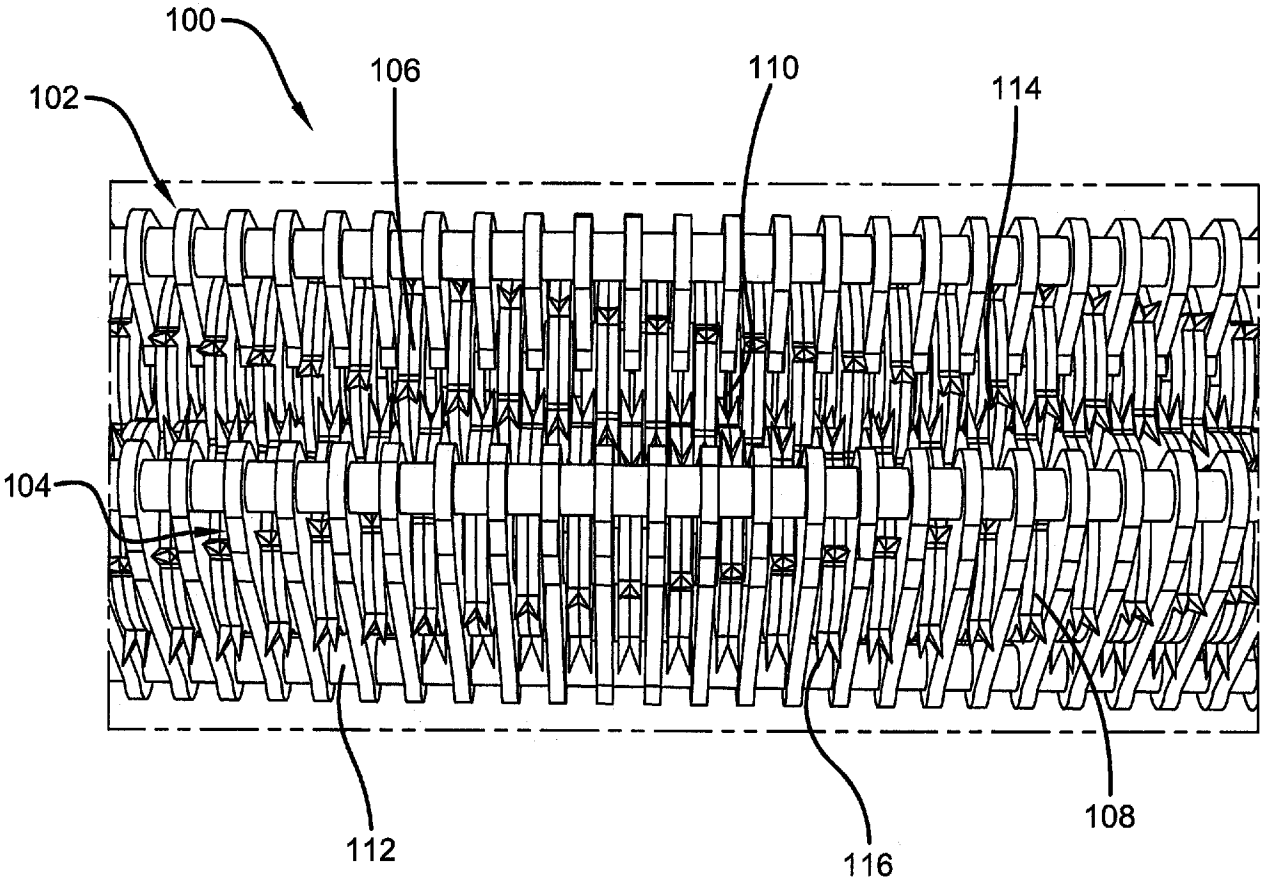
FIG. 2 is a perspective view of the cutting members of the waste processing device.

FIG. 2 is a top view of the cutting region of the waste processing device. Cutting region 100 includes cutting members 102, 104 that are positioned in the same horizontal plane. Each of cutting members 102, 104 includes a plurality of cutters 106, 108 that are mounted on a rotatable shaft 110, 112. Cutters 106, 108 are axially separated from the immediate axial cutter along the entire length of the cutting member 102, 104. Each of the cutting members 102, 104 also includes cutting teeth 114, 116. Cutting teeth 114, 116 of the cutters 106, 108 are positioned at different angles to the relative to the cutting teeth on immediate adjacent cutters 106, 108.

Figure 3:
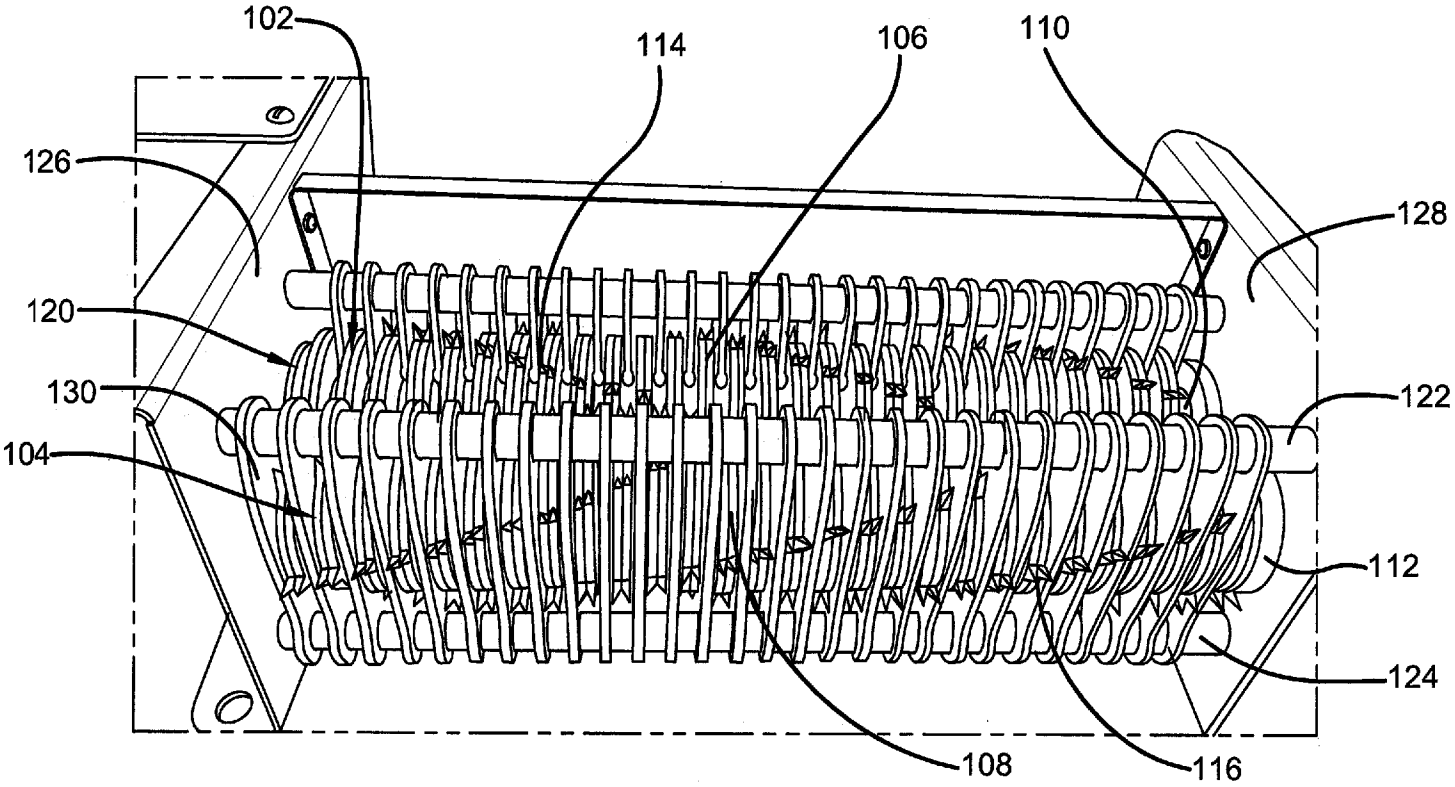
FIG. 3 is a perspective view of the cutting members of the waste processing device.

FIG. 3 is a perspective view of the cutting members of the device. Cutting members 102, 104 that are positioned in the same horizontal plane. Each of cutting members 102, 104 includes a plurality of cutters 106, 108 that are mounted on a rotatable shaft 110, 112. Cutters 106, 108 are axially separated from the immediate adjacent axial cutter along the entire length of the cutting member 102, 104. Each of the cutting members 102, 104 also includes cutting teeth 114, 116. Cutting teeth 114, 116 of the cutters 106, 108 form helical rows 120 of cutters extending along cutting members 102, 104. Upper 122 and lower 124 rails extend between side walls 126, 128. Upper rail 122 is positioned above cutting members 102, 104 and lower rail 124 is positioned below cutting members 102, 104. Spacers 130 are engaged with and supported by the upper 122 and lower 124 rails of the device. Spacers 130 provide axial spacing between cutters 106, 108 along the longitudinal axis of the cutting members.

The device is capable of shredding entire plastic syringes, including needles, into tiny particles by inserting them into the material intake chamber of the device and allowing them to pass into the cutting region. The resulting shredded material is then deposited into a bio-hazard sharps container.

Obliteration of syringes and needles is a deterrent with respect to second hand use of infected medical products. Although there are federal guidelines for preventing theft of controlled substances in health care facilities, the theft of used syringes with respect to illegal intra-venous drug use is on the rise. Hospitals, nursing homes and pharmacies are reporting alarming rates of stolen syringes and needles. Moreover, thefts by health care workers are not uncommon, mainly because health care facilities (of physicians, physical therapists, advanced life support personnel, physician assistants, athletic trainers, occupational therapists, respiratory therapists, nurse practitioners, nurse midwives and dietitians) is where many popularly abused drugs are located.

It has been found that the device efficiently shreds needles and plastic in a few seconds. After medical practitioners have administered injections, the needle and syringe can together be placed into the device for obliteration, eliminating any second hand use. In particular, the needles and/or other shredded material(s) may be rendered unrecognizable. Other devices utilize electricity to destroy the needle without affecting the syringe. However, the resulting air particulates that are emitted is an environmental risk. Conversely, the disclosed device destroys the syringe and renders the needle unusable without the concern of any potentially harmful aerosols that may be emitted during its operation.

The waste processing device is also capable of effectively shredding diabetic lancets, razors and blades, butterfly and hoses. In addition to the use of the device in healthcare and medical institutional settings, the waste processing device may be used by law enforcement personnel to prevent detainees or inmates from using razors and blades in municipal, state, and/or federal detention centers or jails. Shredding these materials prevents inmates from using dangerous needles, blades and razors in physical attacks on law enforcement personnel, other inmates, or facilities.

While the waste disposal device and method for reducing the volume of waste material has been described in connection with various illustrative embodiments, as shown in the Figures, it is to be understood that other similar embodiments may be used or modifications and additions may be made to the described embodiments for performing the same functions. Therefore, the shredding device and method for reducing the volume of waste material should not be limited to any single embodiment, but rather construed in breadth and scope in accordance with the recitation of the appended claims.

The invention claimed is:

1. A waste processing device comprising:

a housing having an upper region and a lower region;

a material intake member and a cutting region located in the upper region;

a pair of elongate counter-rotational cutting members located within the cutting region, said cutting members comprising a plurality of cutters having cutting teeth collectively forming a substantially helical pattern of cutting teeth along at least a portion of the longitudinal axis of said cutting members;

wherein at least a portion of said cutting teeth comprise a forked end;

spacers located between said cutters;

a device to drive the pair of elongate cutting members; and a sensor for activating the opening and closing of said material intake member, said sensor includes a light emitting diode that emits infrared radiation.

2. The waste processing device of claim 1, further comprising a vacuum for extracting material from the internal atmosphere of the housing generated during operation of said device.

3. The waste processing device of claim 1, further comprising a filter for filtering the internal atmosphere of said device.

4. The waste processing device of claim 1, further comprising a vacuum for extracting material from the internal atmosphere of said housing generated during operation of said device; and a filter for filtering the internal atmosphere of said device.

5. The medical waste processing device of claim 1, wherein said housing includes an anti-microbial additive.

6. The medical waste processing device claim 5, wherein said antimicrobial additive comprises a coating on inner surfaces of at least one wall of said housing.

7. The medical waste processing device of claim 5, wherein said antimicrobial additive is incorporated into the walls of said housing.

8. The waste processing device of claim 1, wherein said material intake member comprises an elongated member that extends substantially horizontally along the top wall of the housing and comprises a cavity for accepting medical waste to be processed.

9. The waste processing device of claim 1, wherein said material intake chamber comprises a substantially horizontal tray member that includes a cavity for accepting one or more medical syringes.

10. The waste processing device of claim 9, wherein said material intake member is driven by an electric motor and is capable of opening and closing to accept waste material to be processed.

11. The waste processing device of claim 1, wherein said housing comprises an upper horizontal wall that separates said material intake member from the cutting members and comprises an opening transferring waste to be processed from said material intake member to the cutting members located in the cutting region.

12. The waste processing device of claim 1, wherein said cutting members are located substantially in the same horizontal plane and are arranged for counter-rotation relative to one another.

13. The waste processing device of claim 12, wherein each of said elongate cutting members comprise a plurality of spaced-apart cutters that are mounted on rotatable shafts.

14. The waste processing device of claim 13, wherein each of said cutters are substantially circular in shape and have a plurality of cutting teeth extending radially from the outer circumference of the cutter.

15. The waste processing device of claim 14, wherein each of said cutters on each of the rotating shafts are axially separated from adjacent axial cutters along the longitudinal axis of the cutting members.

16. The waste processing device of claim 15, wherein each of said cutters of the cutting members are mounted on the rotatable shaft so that immediately adjacent cutters do not have cutting teeth in the same angular position.

17. The waste processing device of claim 1, wherein said each of said cutting teeth of the cutting members has a first surface that extends outwardly from the outer circumference of said cutter member at a 90° angle from the point on the surface from which it emanates and a second surface that extends outwardly from the outer circumference of said cutting member at a 70° angle from the point on the surface from which it emanates until it meets the end of the first surface.

18. The waste processing device of claim 17, wherein said cutting members extend between spaced-apart mounting brackets and are rotated by an electric motor.

19. The waste processing device of claim 18, wherein said electric motor rotates said cutting members about their respective rotary axes at variable rotational speeds.

20. The waste processing device of claim 1, further comprising a lower horizontal wall that divides said upper and lower regions of said housing of said device, and comprising an opening to permit shredded medical waste to transfer from said cutting region into the collection member located in said lower region of said housing.

21. The waste processing devices of claim 20, further comprising a lower collection region positioned below said cutting region where the processed medical waste material is collected.

22. The waste processing device of claim 21, wherein said lower collection 15 region of said housing further includes a retractable tray for carrying a collection member.

23. The waste processing device of claim 22, wherein said retractable tray is engaged with spaced-apart mounting rails that permit the tray to be retracted and re-inserted into the lower region of the housing.

24. The waste processing device of claim 1, further comprising a filter is selected from the group consisting of chemical, deep pleated, electronic, fiberglass or polyester, HEPA, ordinary flat or pleated, permanently charged electrostatic, and washable/reusable filters.

25. The waste processing device of claim of claim 1, further comprising a vacuum pump selected from a group including positive displacement pumps, momentum transfer pumps, molecular pumps and entrapment pumps.

26. A waste processing device comprising:

a housing having an upper region and a lower region;

a material intake member and a cutting region located in the upper region;

a pair of elongate counter-rotational cutting members located within the cutting region, said cutting members comprising a plurality of cutters having cutting teeth collectively forming a substantially helical pattern of cutting teeth along at least a portion of the longitudinal axis of said cutting members;

wherein at least a portion of said cutting teeth comprise a forked end;

spacers located between said cutters;

a device to drive the pair of elongate cutting members;

a sensor for activating the opening and closing of said material intake member, said sensor includes a light emitting diode that emits infrared radiation; and a transmitter mounted on one side of said housing, a receiver mounted on an opposing side of said housing.

27. The waste processing device of claim 26, wherein said material intake tray is activated and rotates along its longitudinal axis to drop the syringes to be processed in a horizontal fashion.

* * * * *